US008800512B2

(12) United States Patent
Strauss

(10) Patent No.: US 8,800,512 B2
(45) Date of Patent: Aug. 12, 2014

(54) CAMSHAFT ADJUSTER WITH LOCKING DEVICE

(75) Inventor: Andreas Strauss, Forchheim (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 454 days.

(21) Appl. No.: 12/919,559

(22) PCT Filed: Feb. 24, 2009

(86) PCT No.: PCT/EP2009/001283

§ 371 (c)(1),
(2), (4) Date: Nov. 30, 2010

(87) PCT Pub. No.: WO2009/106283

PCT Pub. Date: Sep. 3, 2009

(65) Prior Publication Data

US 2011/0067657 A1 Mar. 24, 2011

(30) Foreign Application Priority Data

Feb. 29, 2008 (DE) ..... 10 2008 011 915

(51) Int. Cl.
*F01L 1/34* (2006.01)

(52) U.S. Cl.
USPC ..... 123/90.17; 123/90.15

(58) Field of Classification Search
USPC ..... 123/90.15, 90.17
See application file for complete search history.

(56) References Cited

U.S. PATENT DOCUMENTS 5,924,395 A * 7/1999 Moriya et al. ..... 123/90.15
6,155,219 A * 12/2000 Fukuhara et al. ..... 123/90.17
6,439,181 B1 8/2002 Fujiwaki et al.
6,443,112 B1 * 9/2002 Kinugawa ..... 123/90.17
7,198,014 B2 * 4/2007 Kanada et al. ..... 123/90.17
7,363,898 B2 * 4/2008 Suzuki et al. ..... 123/90.17
7,444,964 B2 * 11/2008 Kanada et al. ..... 123/90.15
8,091,524 B2 * 1/2012 Ozawa et al. ..... 123/90.17
8,205,586 B2 * 6/2012 Strauss et al. ..... 123/90.17
8,210,142 B2 * 7/2012 Suzuki et al. ..... 123/90.17
8,261,704 B2 * 9/2012 Takemura ..... 123/90.15
8,281,756 B2 * 10/2012 Suzuki et al. ..... 123/90.17

(Continued)

FOREIGN PATENT DOCUMENTS

DE 19914767 A1 10/1999
DE 19908934 A1 9/2000

(Continued)

*Primary Examiner* — Thomas Denion
*Assistant Examiner* — Steven D Shipe
(74) *Attorney, Agent, or Firm* — Davidson, Davidson & Kappel, LLC

(57) ABSTRACT

A camshaft adjuster which has a locking device by which a drive input and drive output part can be rotationally fixedly locked in a locking rotational position. The locking device has a multiplicity of engagement pairs which include one axial bar which is held in the drive input or drive output part and a bar slot which is formed in the respective other part. The engagement pairs are designed such that, during an adjustment of the drive output part in the drive direction, the bars can be placed in successive engagement with the bar slots in a relative rotational position between an end rotational position, which lags behind in the drive direction, and the locking rotational position. The bar slots prevent an adjustment of the drive output part counter to the drive direction and permit an adjustment in the drive direction until the locking rotational position is reached.

12 Claims, 7 Drawing Sheets

(56) References Cited

U.S. PATENT DOCUMENTS

| | | | | |
|---|---|---|---|---|
| 2002/0139332 | A1* | 10/2002 | Takenaka | 123/90.17 |
| 2003/0121486 | A1* | 7/2003 | Komazawa et al. | 123/90.17 |
| 2005/0016481 | A1* | 1/2005 | Komazawa et al. | 123/90.17 |
| 2006/0130790 | A1* | 6/2006 | Kanada et al. | 123/90.17 |
| 2009/0250028 | A1* | 10/2009 | Fujiyoshi et al. | 123/90.17 |
| 2010/0037841 | A1* | 2/2010 | Strauss et al. | 123/90.15 |
| 2011/0067657 | A1* | 3/2011 | Strauss | 123/90.15 |
| 2011/0088645 | A1* | 4/2011 | Yamaguchi et al. | 123/90.17 |
| 2011/0162601 | A1* | 7/2011 | Fujiyoshi et al. | 123/90.15 |
| 2011/0271919 | A1* | 11/2011 | Kaneko | 123/90.15 |
| 2012/0017858 | A1* | 1/2012 | Yokoyama et al. | 123/90.15 |
| 2012/0152190 | A1* | 6/2012 | Kobayashi et al. | 123/90.15 |
| 2012/0234275 | A1* | 9/2012 | Fischer et al. | 123/90.17 |
| 2012/0255509 | A1* | 10/2012 | Lichti et al. | 123/90.15 |

FOREIGN PATENT DOCUMENTS

| | | | |
|---|---|---|---|
| DE | 10213831 | A1 | 11/2002 |
| DE | 202005008264 | U1 | 9/2005 |
| DE | 02005013141 | A1 | 9/2006 |
| DE | 102005036707 | A1 | 2/2007 |
| EP | 1452700 | A1 | 9/2004 |
| EP | 1596040 | A2 | 11/2005 |
| WO | 2004/033860 | A1 | 4/2004 |

* cited by examiner

CAMSHAFT ADJUSTER WITH LOCKING DEVICE

This application claims the priority of both DE 10 2008 011 915.6 filed Feb. 29, 2008, and PCT/EP2009/001283 filed Feb. 24, 2009, which are both incorporated by reference herein.

FIELD OF THE INVENTION

The invention lies in the technical field of internal combustion engines and relates to a camshaft adjuster for an internal combustion engine, said camshaft adjuster being equipped with a locking device for locking the drive part and output part in a rotary locking position.

PRIOR ART

In an internal combustion engine, mechanical actuation of gas exchange valves takes place via a camshaft set in rotation by a crankshaft, and opening and closing time points of the gas exchange valves can be set in a directed manner via the arrangement and form of the cams.

If the opening and closing time points of the gas exchange valves are suitably controlled as a function of the instantaneous operating state of the internal combustion engine, a series of advantageous effects can be achieved, such as a reduction in pollutant emission, a lowering of the fuel consumption and an increase in the efficiency, maximum torque and maximum power of the internal combustion engine. The opening and closing time points of the gas exchange valves can be adjusted by means of a change in the relative rotary position (phase position) between the camshaft and crankshaft, for which purpose special devices, what are known as camshaft adjusters, are employed in modern motor vehicles.

Camshaft adjusters comprise a drive part drive-connected to the crankshaft, a camshaft-fixed output part and an actuating mechanism which is inserted between the drive part and output part and which transmits the torque from the drive part to the output part and makes it possible to fix and adjust the relative rotary position between these two.

In a rotary piston adjuster, a camshaft-fixed concentric inner rotor ("rotor") is mounted in a rotationally adjustable manner in a central cavity of an outer rotor ("stator") driven by the crankshaft. In an embodiment as a vane-cell adjuster, working spaces arranged so as to be distributed in the circumferential direction are formed in the stator, into which working spaces in each case a radial vane connected to the rotor extends, with the result that each working space is divided into two essentially pressure-tight pressure chambers. In terms of the working direction of the camshaft, each vane divides the working space into a leading pressure chamber and a trailing pressure chamber. By the directed application of pressure to the pressure chambers, the vanes within the working spaces can be pivoted, the result of this being that a change in the relative rotary position (phase position) between the camshaft and crankshaft is brought about via the rotor connected fixedly in terms of rotation to the camshaft. The adjustment angle between the rotor and stator is limited as a result of the abutment of the vanes against the radial walls of the working spaces or by means of special devices for limiting the adjustment angle.

The vane-cell adjuster is controlled by means of an electronic control device which, on the basis of electronically detected characteristic data of the internal combustion engine, such as, for example, rotational speed and load, regulates the inflow and outflow of pressure medium to and from the individual pressure chambers via a control valve designed, for example, as a proportional valve.

While the internal combustion engine is in operation, alternating moments arise on the camshaft. The reason for this is that the cams, in the region of their run-on ramp, have to open the gas exchange valve, held in the closing position by a valve spring, counter to the spring force, with the result that the drive torque is increased, and, in the region of their run-off ramp, are acted upon by the spring force, with the result that the drive torque is reduced. The alternating moments generated are transmitted to the rotor connected fixedly in terms of rotation to the camshaft.

If there is an insufficient supply of pressure medium, as is the case, for example, during the starting phase of the internal combustion engine or during idling, the alternating moments transmitted from the camshaft to the rotor have the effect that the rotor is moved in an uncontrolled way, the result of this being that the vanes within the working spaces beat back and forth, this being conducive to wear and causing an undesirable amount of noise generated. Moreover, the phase position between the crankshaft and camshaft fluctuates greatly, and therefore the internal combustion engine does not start or runs jerkily.

In order to avoid this problem, hydraulic camshaft adjusters are equipped with a locking device for locking the stator and rotor fixedly in terms of rotation. Such a locking device comprises, for example, an axial locking bolt which is received in the rotor and which is forced by a spring in the axial direction out of its receptacle and can engage positively into a locking slot which is formed in an axial side plate of the stator. For unlocking, the locking bolt is acted upon on the end face with pressure medium and is forced back into its receptacle in the rotor.

Locking the stator and rotor takes place in a phase position of the camshaft which is designated as a basic position and is beneficial thermodynamically for starting the internal combustion engine. Depending on the actual design of the internal combustion engine, the basic position selected is an early, late or intermediate position. In terms of the drive direction of the stator or camshaft, the late position corresponds to a rotary end position of the rotor in the trailing direction (in which the volumes of the leading pressure chambers are at a maximum), the early position corresponds to a rotary end position of the rotor in the leading direction (in which the volumes of the trailing pressure chambers are at a maximum), and the intermediate position corresponds to a phase position which is between the early and the late position.

An intermediate position which is at least approximately in the middle between the early and the late position is designated as a middle position. Adjustment of the phase position of the rotor in a direction of rotation identical to the drive direction of the stator or camshaft is designated as early adjustment. Adjustment of the phase position of the rotor in a direction of rotation opposite to this is designated as late adjustment.

Vane-cell adjusters with a locking device for locking the stator and rotor fixedly in terms of rotation in the basic position are sufficiently known as such and are described in detail, for example, in the applicant's publications DE 20 2005 008 264 U1, EP 1 596 040 A2, DE 10 2005 013 141 A1 and DE 199 08 934 A1.

If the basic position is not reached when the internal combustion engine is stopped (for example, when the engine is "stalled"), the rotor is automatically adjusted into the late position on account of frictional moments. If the rotor is to be locked in the early or an intermediate position, therefore, special measures have to be taken to adjust the rotor in relation to the stator. For this purpose, in conventional camshaft adjusters, for example, torsion springs are provided which pretension the rotor in the direction of the desired basic position.

In a more refined mechanism which is described in U.S. Pat. No. 6,439,181 B1, in addition to a torsion spring for rotating the rotor into the early position, radial locking plates in the stator are provided which, in the event of an early adjustment of the rotor, can engage into a slot formed in the rotor, in order, even before the basic position is reached, to prevent the rotor from turning back into the late position again. The locking plates received in the stator are, for this purpose, in each case pressed in the direction of the rotor or into the associated slot by a spring and can be forced back into the stator as a result of hydraulic action upon them.

One disadvantage of the camshaft adjuster known from U.S. Pat. No. 6,439,181 B1 is, in particular, that the small locking plates received in the stator are directed radially, so that they are exposed to the centrifugal force arising during the rotation of the stator. On the one hand, this necessitates correspondingly high spring forces of the springs by which the small locking plates are pressed in the direction of the rotor, in order to prevent an unintentional release of the lock. On the other hand, the pressure to be applied in order to unlock the small locking plates hydraulically depends on the centrifugal force which takes effect, thus making hydraulic regulation difficult.

Another disadvantage is that, owing to the small locking plates used, the space available for the working spaces or pressure chambers is reduced. So that a sufficiently large number of working spaces can be implemented, the number of small locking plates used must therefore be kept relatively low, in the example shown there are three small locking plates.

A further disadvantage of the camshaft adjuster shown there arises due to the fact that an unbalance is generated in the rotating stator as a result of the locking plates which are not distributed uniformly in the circumferential direction, and therefore the mounting of the stator and rotor may be impaired and the phase position of the rotor may fluctuate.

OBJECT OF THE INVENTION

By contrast, the object of the invention is to make available a camshaft adjuster for an internal combustion engine, by means of which the above and further disadvantages can be avoided.

SOLUTION FOR ACHIEVING THE OBJECT

This and further objects are achieved according to the proposal of the invention by means of a generic camshaft adjuster having the features of the independent patent claim. Advantageous refinements of the invention are specified by the features of the subclaims.

According to the invention, a camshaft adjuster for an internal combustion engine is shown. The camshaft adjuster comprises a drive part drive-connected to a crankshaft and rotatable synchronously with the crankshaft and a camshaft-fixed output part which is mounted concentrically and rotationally adjustably with respect to the drive part. Connected between the drive part and output part is a, for example, hydraulic actuating mechanism which transmits the torque from the drive part to the output part and makes it possible to fix and adjust the relative rotary position between these two.

The phase position of the output part can be adjusted within a maximum rotary angle range. In terms of the direction of rotation or drive direction of the drive part (designated hereafter as the "drive direction"), the output part can be adjusted in a rotary angle range between a rotary end position (early position) leading in the drive direction and a correspondingly trailing rotary end position (late position).

The camshaft adjuster according to the invention comprises a locking device, by means of which the drive part and output part can be locked fixedly in terms of rotation in a selectable rotary locking position (basic position) different from the late position. The drive part and output part can be locked fixedly in terms of rotation, for example, in the early position or a middle position.

The camshaft adjuster according to the invention is distinguished essentially in that the locking device has a plurality of (for example at least four) engagement pairs which in each case have a locking bolt (for example, a piston-shaped locking pin) received in the drive part or output part and a circumferentially extending locking slot which is assigned to said locking bolt and is formed in the corresponding other part. The locking bolts can be brought in each case into engagement with the assigned locking slots by means of a movement mechanism, for example in that they can be forced by a spring element in the axial direction out of their receptacle and be forced back into their receptacle by being acted upon on the end face with pressure medium.

In the camshaft adjuster according to the invention, the engagement pairs are designed and arranged such that, in a relative rotary position between the rotary end position (late position) trailing in the drive direction and the rotary locking position (basic position), their locking bolts can be brought into engagement with the locking slots assigned in each case. The engagement pairs are designed, in particular, such that, in the event of an adjustment of the output part in the drive direction of the drive part, their locking bolts can be brought into successive engagement with the locking slots, and, with the locking bolts coming into engagement, the locking slots in each case inhibit adjustment of the output part opposite to the drive direction (late adjustment) and allow adjustment in the drive direction (early adjustment) until the rotary locking position is reached. Thus, by means of the engagement pairs, a stepped latching of the output part opposite to the drive direction until the rotary locking position is reached can be implemented.

The axial orientation of the locking bolts of each engagement pair advantageously makes it possible to avoid the situation where a locking position is varied on account of the centrifugal force generated during the synchronous rotation of the drive part and output part with the crankshaft. Moreover, the construction space available for the working spaces or pressure chambers is not reduced, and therefore a relatively large number of engagement pairs and therefore a multiplicity of latching steps, which assume a relatively small angular interval from one another, may be arranged.

Especially advantageously, engagement pairs are designed such that, in the event of respective adjustment of the output part in the drive direction by the amount of first rotary angles, which are in each case smaller than a second rotary angle by which the output part is adjusted on average on account of alternating moments of the camshaft, the locking bolts can engage successively into the locking slots. What can thereby advantageously be achieved is that the output part can be brought into the rotary locking position via a plurality of latching steps solely on account of the alternating moments transmitted from the camshaft to the output part and can be locked fixedly into rotation with the drive part there. The first rotary angles by the amount at which the drive part is in each case adjusted in the drive direction may be identical to or different from one another.

If the engagement pairs are arranged so as to be distributed uniformly in the circumferential direction, it is advantageously possible to avoid the situation where unbalance is generated in the camshaft adjuster rotated synchronously with the crankshaft.

In the camshaft adjuster according to the invention, rotationally fixed locking of the drive part and output part in the rotary locking position can take place by means of a single engagement pair which comprises a locking bolt received in the drive part or output part and a locking slot formed in the corresponding other part, the engagement pair being designed such that the locking bolt can be brought into positive engagement with the assigned locking slot.

In the camshaft adjuster according to the invention, rotationally fixed locking of the drive part and output part in the rotary locking position can likewise take place by means of two engagement pairs, which in each case comprise a locking bolt received in the drive part or output part and a locking slot formed in the corresponding other part, in one engagement pair the locking bolt being capable of being brought into engagement with its assigned locking slot such that adjustment of the output part opposite to the drive direction is inhibited, and, in the other engagement pair, the locking bolt being capable of being brought into engagement with its assigned locking slot such that adjustment of the output part in the drive direction is inhibited.

The camshaft adjuster according to the invention is preferably designed in the form of a vane-cell adjuster, and in this case, in particular, in each engagement pair the locking bolt is preferably received in the rotor and the locking slot is formed in the stator, for example in an axial side or cover plate.

The invention extends, furthermore, to an internal combustion engine which is equipped with at least one camshaft adjuster, as described above.

Moreover, the invention extends to a motor vehicle with an internal combustion engine which is equipped with at least one camshaft adjuster, as described above.

BRIEF DESCRIPTION OF THE DRAWINGS

The invention is now explained in more detail by means of exemplary embodiments, reference being made to the accompanying drawings. Identical or identically acting elements are designated by the same reference numerals in the drawings in which.

DETAILED DESCRIPTION OF THE DRAWINGS

Referring to FIG. 1 to FIG. 6, according to a first exemplary embodiment of the invention, a hydraulic vane-cell adjuster 1 based on the rotary piston principle is explained by means of corresponding sectional illustrations.

Figure 1:
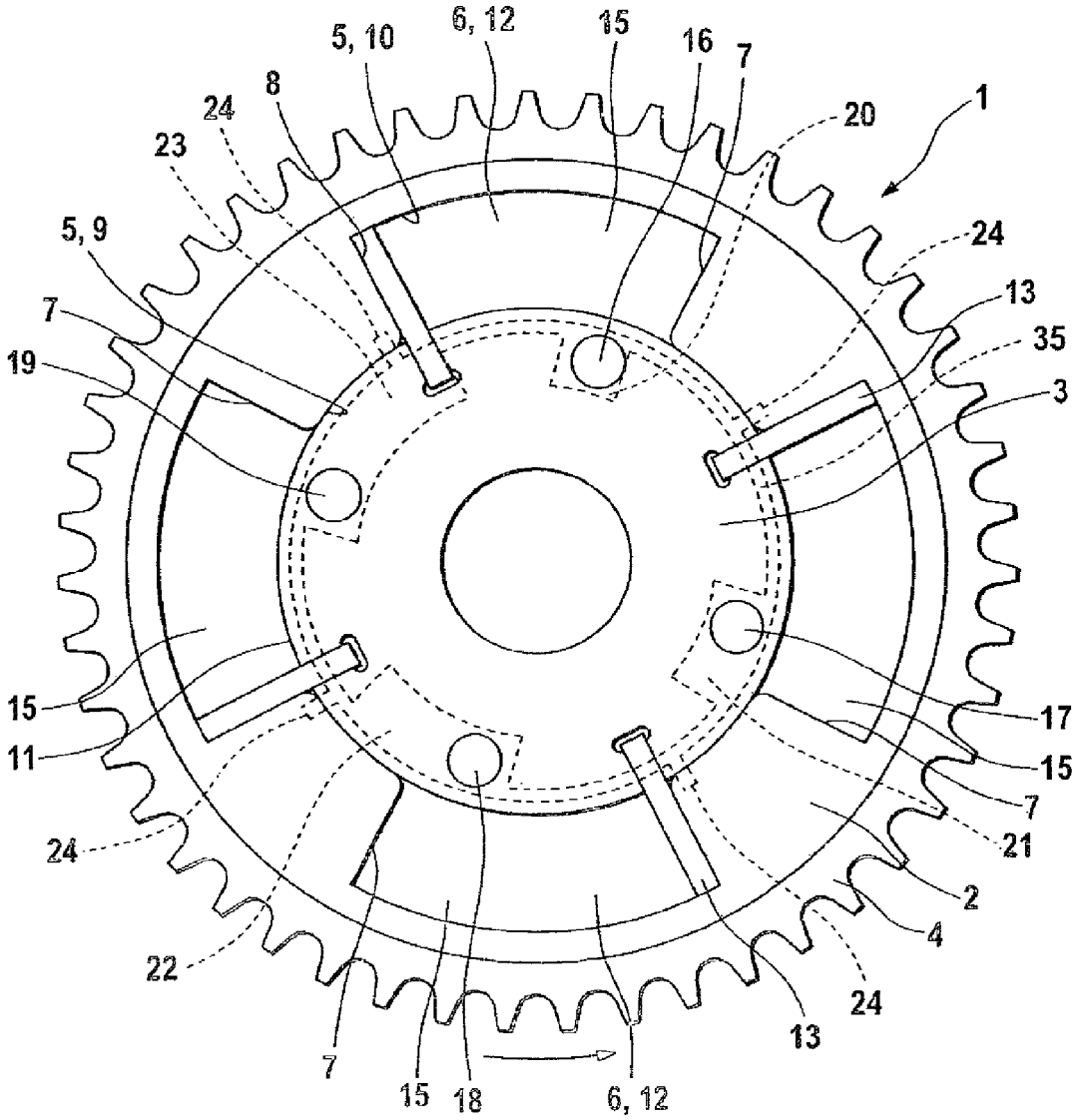
FIG. 1 shows, in a section perpendicular to the axis of rotation, a vane-cell adjuster according to the invention with a rotor locked in the early position.

Thus, the vane-cell adjuster 1 comprises, as a drive part, an outer rotor or stator 2 drive-connected to a crank shaft (not illustrated) via a chain wheel 4 and, as an output part, an inner rotor or rotor 3 which is arranged concentrically in a central cavity of the stator 2 and which is attached fixedly in terms of rotation to a camshaft (not illustrated) on its end face, for example, by means of a screw connection. The stator 2 is rotated counterclockwise synchronously with the crankshaft, as indicated in FIG. 1 by the arrow, with the result that the working direction or drive direction of the camshaft is fixed.

An inner surface area 5 delimiting the cavity of the stator 2 is provided with a plurality of radial recesses 6 which are delimited in each case by a first radial side wall 7 and a second radial side wall 8. The inner surface area 5 of the stator 2 comprises, furthermore, inner circumferential walls 9 extending in the circumferential direction and outer circumferential walls 10 extending in the circumferential direction, which are connected to one another by means of the radial side walls 7, 8.

The stator 2 is rotatably mounted, via its inner circumferential walls 9 which bear against an outer surface area 11 of the rotor 3, on the rotor 3. The radial recesses 6 of the stator 2 form, together with the outer surface area 11 of the rotor 3 and two axial sealing surfaces, which are explained in more detail further below, hydraulic working spaces 12 (here, for example, four working spaces 12) which are arranged so as to be distributed uniformly in the circumferential direction. Merely for the sake of completeness, it may be mentioned that a larger or smaller number of working spaces is possible.

A vane 13, emanating from the rotor 3, projects radially outward into each working space 12, with the result that the working spaces 12 are divided in each case into a pair of mutually acting pressure chambers 14, 15. In terms of the drive direction of the stator 2, these are a leading first pressure chamber 14 (pressure chamber "A"), and a trailing second pressure chamber 15 (pressure chamber "B").

The vanes 13 are received in axial grooves which are formed in the outer surface area 11 of the rotor 3. Spring elements exerting load radially outward may be arranged on the groove bottom of the axial grooves, the effect of this being that the vanes 13 bear sealingly against the outer circumferential wall 10 of the stator 3. It would likewise also be possible to form the vanes 13 in one part with the rotor 3.

The stator 2 forms a housing pressure-tightly encapsulating the rotor 3 and having two axial side or sealing plates, to be precise a sealing plate 33 further from the camshaft having a sealing surface 34 facing the camshaft and a sealing plate nearer to the camshaft having a sealing surface facing away from the camshaft. The working spaces 12 or pressure chambers 14, 15 are closed pressure-tightly in the axial direction by means of the two sealing surfaces.

In each case pressure medium lines, not illustrated, issue into the two pressure chambers 14, 15 of each working space 12, through which pressure medium lines, pressure medium (for example hydraulic oil) can be supplied to the pressure chambers or discharged from these. By the directed admission flow of pressure medium, a pressure gradient can be built up between the pair of pressure chambers 14, 15 of each working space 12, thus causing pivoting of the vanes 13 and therefore a change in the relative rotary position (phase position) of the rotor 3 with respect to the stator 2.

The first radial side wall 7 and the second radial side wall 8 of each working space 12 form in each case a limit stop for the vane 13 projecting into the working space 12. In terms of the working direction of the camshaft, the rotor 3 is in the late position in the event that the vanes 13 in each case bear against the first radial side wall 7. On the other hand, the rotor 3 is in the early position in the event of the vanes 13 bearing in each case against the second radial side wall 8. The two limit stops predetermine a maximum possible adjustment angle of the rotor 3 with respect to the stator 2. Although this is not illustrated, a maximum possible adjustment angle of the rotor 3 may likewise be predetermined by a special rotary angle limitation device, for example in order to prevent the vanes from striking the radial side walls 7, 8 in the case of a stator 2 manufactured from sheet metal.

If alternating moments occur on the camshaft while the internal combustion engine is in operation, these are transmitted to the rotor 3 if the supply of pressure medium is insufficient. In order to avoid a situation where the vanes 13 beat back and forth in an uncontrolled way in the working spaces 12, the rotor 3 can be locked fixedly in terms of rotation with the stator 2 in the early position by means of a locking device.

For this purpose, the locking device comprises four axial locking bolts 16-19 which are arranged so as to be distributed uniformly in the circumferential direction and which are in each case received in a recess in the rotor 3. The locking bolts 16-19 are in each case forced by a spring element in the direction of the sealing surface 34 facing the camshaft, which is not illustrated in any more detail in the figures.

Depending on the phase position of the rotor 3, the locking bolts 16-19 can engage into an associated locking slot 20-23, said locking slots being formed by the first sealing plate 33 further from the camshaft. The locking slots 20-23 are in each case illustrated by dashes in FIGS. 1 to 6.

The locking bolts 16-19 can be acted upon hydraulically on the end face, with the result that they can be forced back into their receptacles in the rotor 3 counter to the spring force of the respective spring elements. For this purpose, in each case a pressure medium line 24 for supplying the locking slots with pressure medium issues into the locking slots 20-23. The locking slots can be fed with pressure medium via the pressure chambers "A" or, alternatively, via the pressure chambers "B". A separate supply of pressure medium is likewise possible. The locking slots are flow-connected to one another via a pressure medium corridor 35.

FIG. 1 illustrates a situation in which the rotor 3 is in a basic position (early position) in which all four locking bolts 16-19 are received in their respective locking slots 20-23, a first locking bolt 16 engaging into a first locking slot 20, a second locking bolt 17 into a second locking slot 21, a third locking bolt 18 into a third locking slot 22 and a fourth locking bolt 19 into a fourth locking slot 23.

A positive connection between the stator 2 and rotor 3, with the result that the stator and rotor are locked fixedly in terms of rotation, is brought about only by the first locking bolt 16 engaging into the first locking slot 20. The second to fourth locking bolts 16-17 merely inhibit a late adjustment of the rotor 3. When the locking bolts 16-17, in particular the first locking bolt 16, are acted upon with pressure medium, the rotationally fixed lock between the stator and rotor can be released.

If the basic position (early position) of the rotor 3 cannot be assumed by regulation (that is to say, by the regulation of pressure medium) when the internal combustion engine stops, the locking device 1, in cooperation with the alternating moments transmitted to the camshaft, has the effect that the early position of the rotor 3 is assumed and the rotor 3 and stator 2 are locked fixedly in terms of rotation in the early position, as is explained in more detail later.

Figure 2:
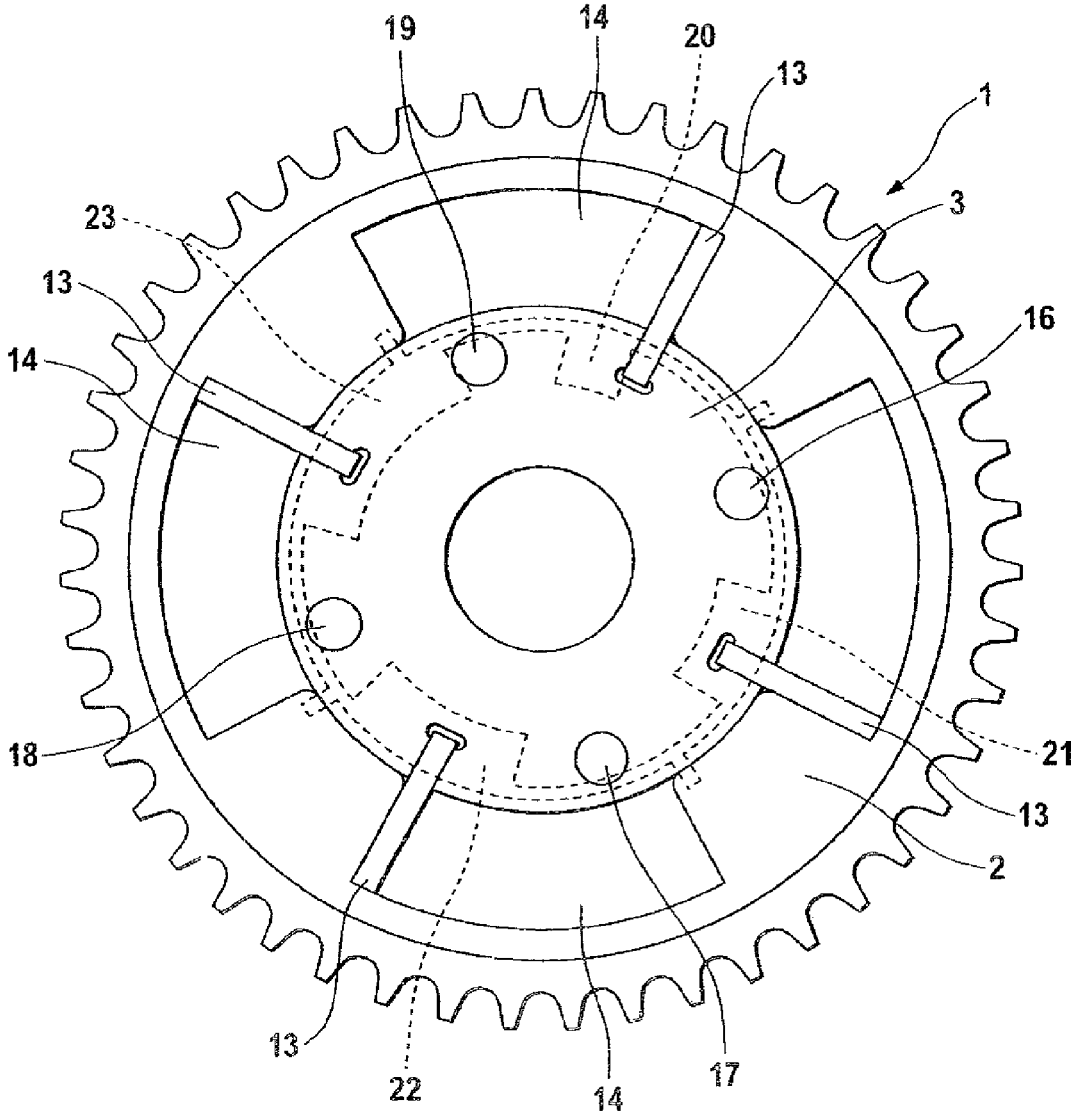
FIG. 2 shows, in further sectional illustration, the vane-cell adjuster of FIG. 1 with the rotor in a late position.

FIG. 2 shows a situation in which the rotor 3 is in the late position, a position which is assumed automatically by the rotor 3 if there is an insufficient supply of pressure medium. In the late position, the vanes 13 bear against the first radial side walls 7. In this phase position, none of the four locking bolts 16-19 can engage into its locking slot.

Figure 3:
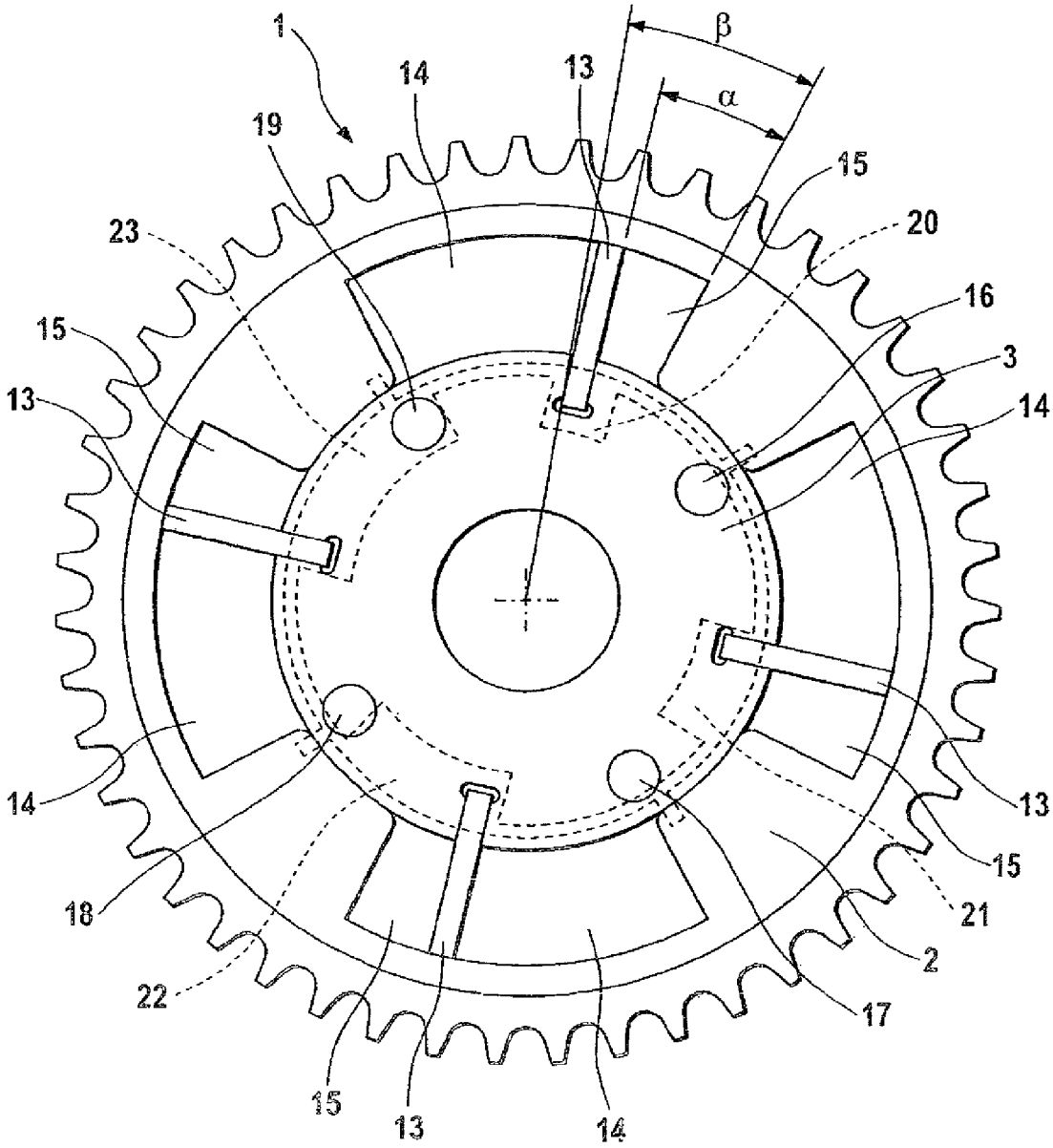
FIG. 3 shows, in a further sectional illustration, the vane-cell adjuster of FIG. 1, the rotor having been adjusted in the direction of the early position with respect to the phase position shown in FIG. 2.

If there is an insufficient supply of pressure medium, alternating moments are transmitted from the camshaft to the rotor 3, which have the result, as shown in FIG. 3, that the rotor 3 is rotated by the amount of a mean rotary angle $\beta$ in the direction of the early position. As is evident, furthermore, from FIG. 3, the fourth locking bolt 19 and the fourth locking slot 23 are designed and arranged such that, even in the event of a rotation of the rotor by the amount of a smaller rotary angle $\alpha$, the fourth locking bolt 19 can engage into the fourth locking slot 23. The fourth locking slot 23 extends in a circumferential direction such that it inhibits late adjustment of the rotor 3 due to the abutment of the fourth locking bolt 19 against the slot wall, but allows further early adjustment of the rotor 3 toward the early position. When the fourth locking bolt 19 engages into the fourth locking slot 23, the rotor 3 is thus latched, in terms of late adjustment, in an intermediate position which is designated hereafter, for the sake of easier reference, as the "first intermediate position" and from which only further early adjustment is possible. Since the rotary angle $\alpha$, upon the reaching of which the fourth locking bolt 19 can engage into the fourth locking slot 23, is smaller than the mean rotary angle $\beta$ of an oscillation of the rotor 3 caused by an alternating moment, it is possible to ensure that, if there is an insufficient supply of pressure medium, a rotor 3 which is in the late position is always rotated as a result of the alternating moments to an extent such that the fourth locking bolt 19 can engage into the fourth locking slot 23.

Figure 4:
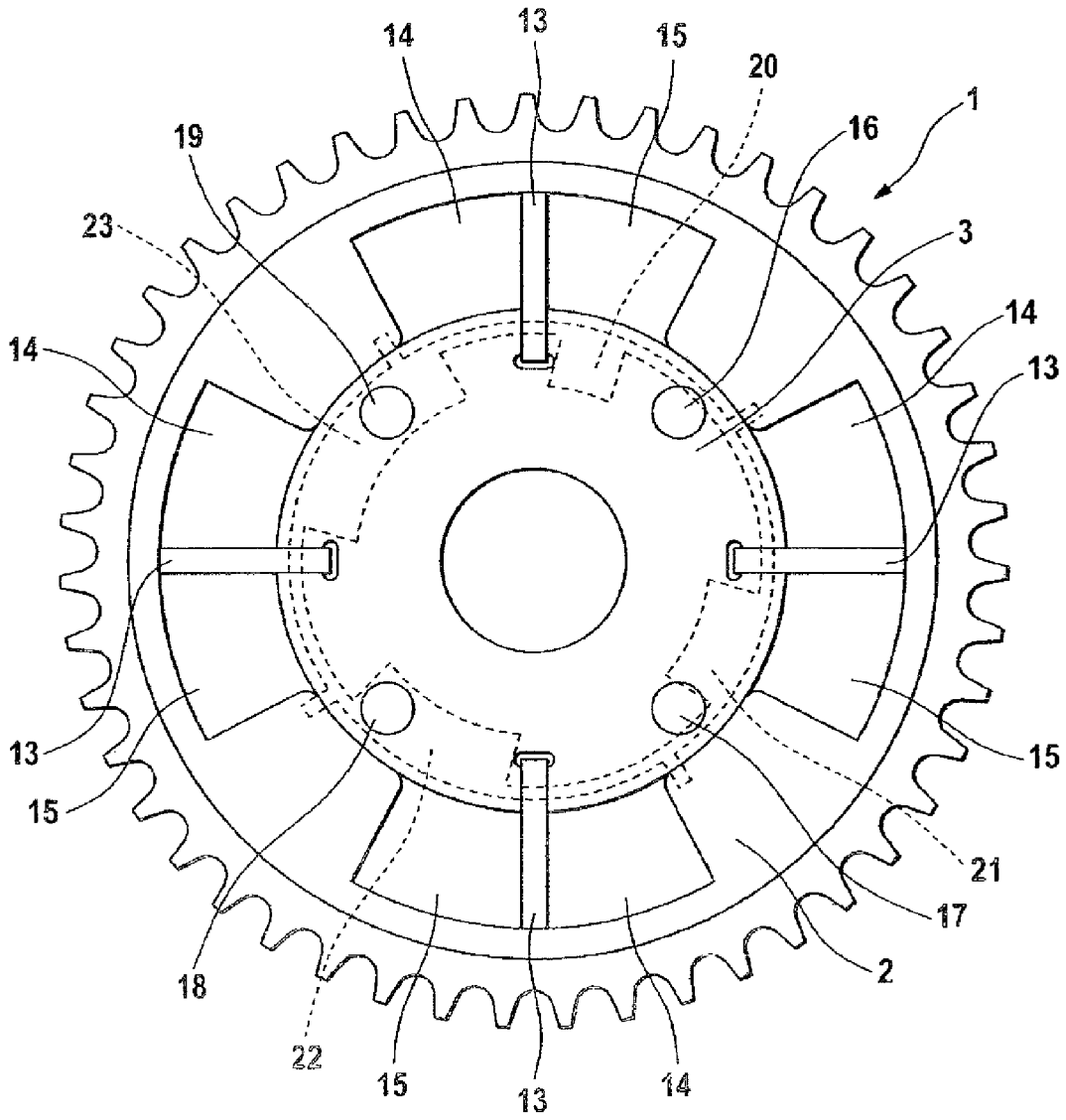
FIG. 4 shows, in a further sectional illustration, the vane-cell adjuster of FIG. 1, the rotor having been adjusted further in the direction of the early position with respect to the phase position shown in FIG. 3.

As shown in FIG. 4, the result of a further transmission of alternating moments to the rotor 3 is that the rotor, then starting from the first intermediate position, is rotated by the amount of the mean rotary angle $\beta$ in the direction of early adjustment, so that the third locking bolt 18 can engage into the third locking slot 22 and latches the rotor 3 with regard to late adjustment. The third locking bolt 18 and the third locking slot 22 are arranged such that, even in the event of rotation of the rotor 3 by the amount of the same smaller rotary angle $\alpha$, the third locking bolt 18 can engage into the third locking slot 23. The third locking slot 22 inhibits late adjustment of the rotor 3 due to the abutment of the third locking bolt 18 against the slot wall, but extends in the circumferential direction such that it allows further early adjustment of the rotor 3 toward the early position. The intermediate position, shown in FIG. 4, of the rotor is designated as the "second intermediate position".

Figure 5:
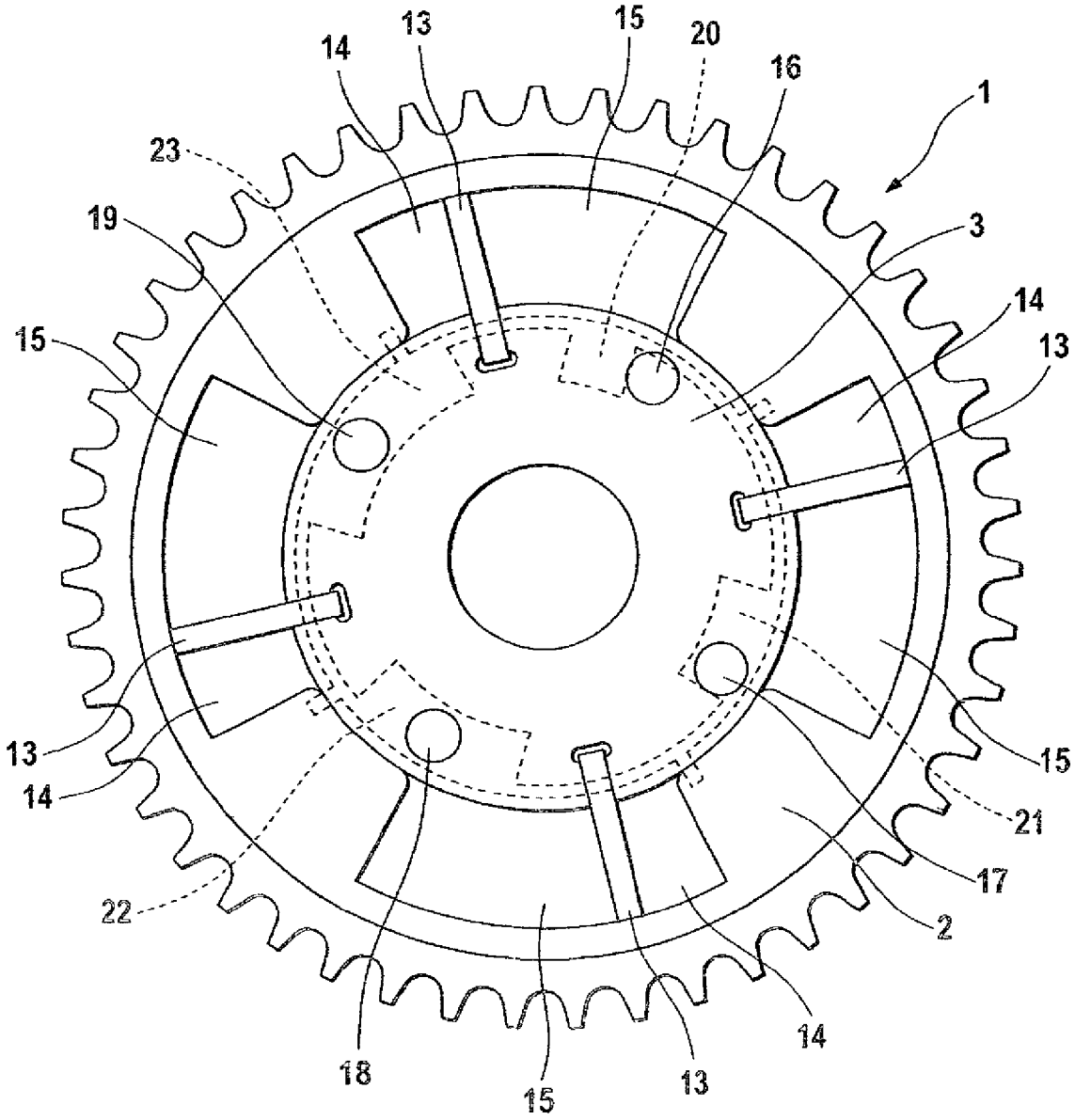
FIG. 5 shows, in a further sectional illustration, the vane-cell adjuster of FIG. 1, the rotor having being adjusted further in the direction of the early position with respect to the phase position shown in FIG. 4.

As shown in FIG. 5, the result of further transmission of alternating moments to the rotor 3 is that the rotor, then starting from the second intermediate position, is again rotated by the amount of the mean rotary angle $\beta$ in the direction of early adjustment, so that the second locking bolt 17 can engage into the second locking slot 21 and latches the rotor 3 with regard to late adjustment. The second locking bolt 17 and the second locking slot 21 are arranged such that, in the event of rotation of the rotor 3 by the amount of the same smaller rotary angle α, the second locking bolt 17 can engage into the second locking slot 21. The second locking slot 21 inhibits late adjustment of the rotor 3 due to the abutment of the second locking bolt 17 against the slot wall, but extends in the circumferential direction such that it allows further early adjustment of the rotor 3 toward the early position. The intermediate position, shown in FIG. 5, of the rotor is designated as the "third intermediate position".

The result of further transmission of alternating moments of the rotor 3 is that the rotor, then starting from the third intermediate position, is rotated into the early position, so that the first locking bolt 16 can also engage into the first locking slot 20, thus making between the rotor 3 and stator 2 a positive connection by means of which the rotor and stator are locked fixedly in terms of rotation. The first locking bolt 16 and the first locking slot 20 are designed and arranged such that, in the event of the same smaller rotary angle α, the first locking bolt 16 can engage into the first locking slot 20.

Figure 6:
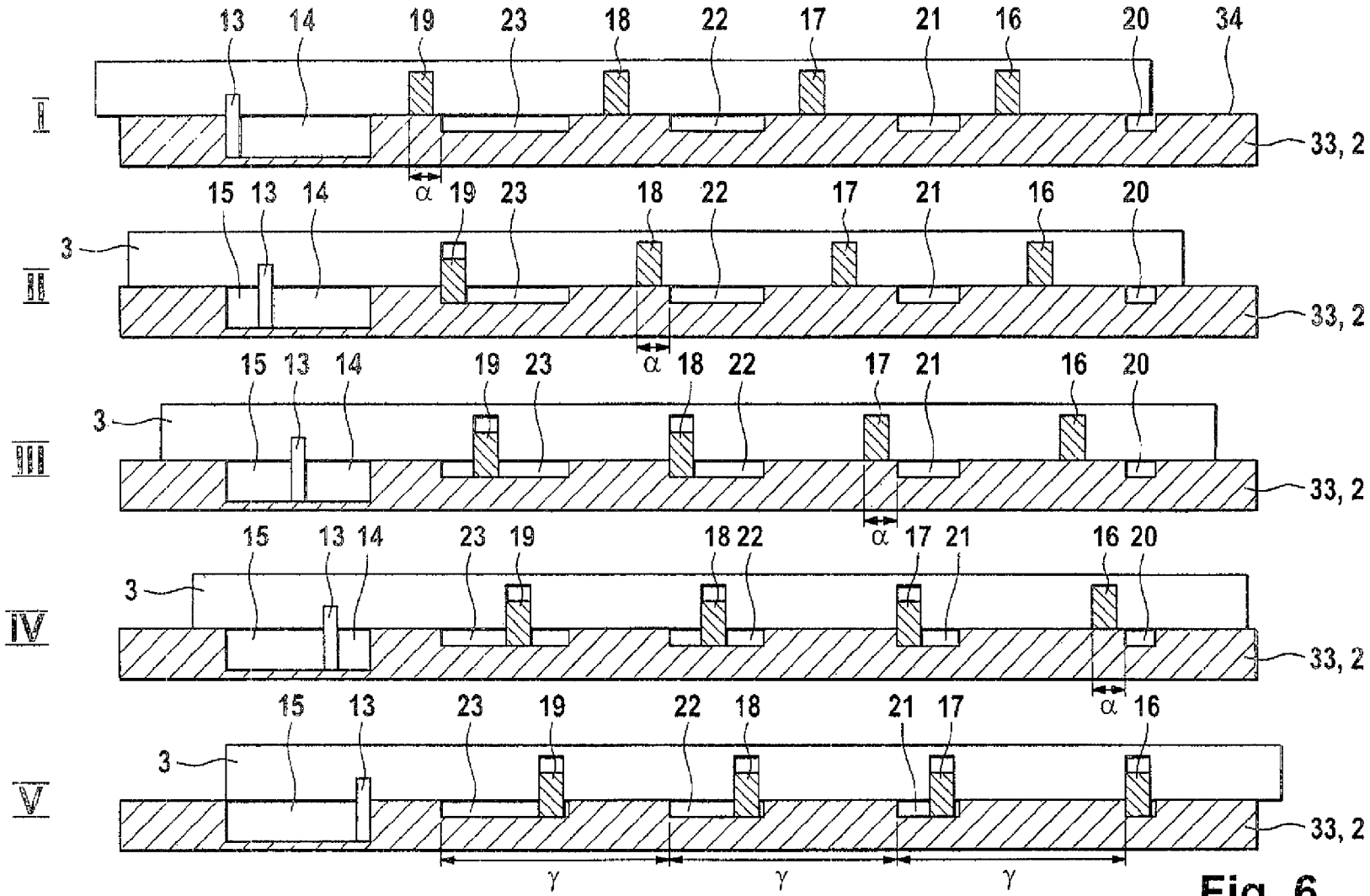
FIG. 6 shows various schematic illustrations to illustrate the positions of the locking bolts in the phase positions of the rotor which are shown in FIG. 1 to FIG. 5.

FIG. 6 makes clear the respective positions of the four locking bolts 16-19 in the various phase positions of the rotor which are illustrated in FIGS. 1 to 5, by means of schematic illustrations I to V which show the rotor and stator in "unrolled" axial section. Moreover, the position of the vane 13 in the working spaces 12 is made clear, the working space 12 being depicted as located in the stator merely for the purpose of simpler illustration.

Illustration I corresponds to the phase position of FIG. 2, that is to say the rotor 3 is in the late position in which no locking bolt can engage into its locking slot. Illustration II corresponds to the phase position of FIG. 3, in which the rotor 3 is in the first intermediate position in which only the fourth locking bolt 19 engages into the fourth locking slot 23 and inhibits the late adjustment of the rotor, but allows its early adjustment. Illustration III corresponds to the phase position of FIG. 4, that is to say the rotor 3 is in the second intermediate position in which the fourth locking bolt 19 engages into the fourth locking slot 23 and the third locking bolt 18 into the third locking slot 22, only the third locking bolt 18 inhibiting late adjustment of the rotor, but allowing its early adjustment. Illustration IV corresponds to the phase position of FIG. 5, that is to say the rotor 3 is in the third intermediate position in which the fourth locking bolt 19 engages into the fourth locking slot 23, the third locking bolt 18 into the third locking slot 22 and the second locking bolt 17 into the second locking slot 21, only the second locking bolt 17 inhibiting late adjustment of the rotor, but allowing its early adjustment. Illustration V corresponds to the phase position of FIG. 1, that is to say the rotor 3 is in the early position in which all four locking bolts 16-19 engage into their respective locking slots 20-23, rotationally fixed locking of the rotor 3 and stator 2 being achieved by means of the positive connection between the first locking bolt 16 and the first locking slot 20.

As is evident particularly from FIG. 6, the second, third and fourth locking slots extend in each case in the circumferential direction such that they allow early adjustment of the rotor 3 toward the early position. Correspondingly to the travel of the locking bolt to be executed within an associated locking slot in the event of further early adjustment of the rotor 3, the dimension in the circumferential direction of the fourth locking slot 23 is greater than the dimension in the circumferential direction of the third locking slot 22. Likewise, that of the third locking slot 22 is greater than that of the second locking slot 21, and that of the second locking slot 21 is greater than that of the first locking slot 20, the latter positively surrounding the first locking bolt 16. Rotary angle α, by the amount of which the rotor 3 has to be rotated further in the direction of the early position in each case after the latching of a locking bolt, so that the next locking bolt can latch, is in each case identical. As indicated for illustration V, the locking slots 20-23 arranged so as to be distributed uniformly in the circumferential direction are in each case spaced apart from one another at an identical rotary angle γ.

Figure 7:
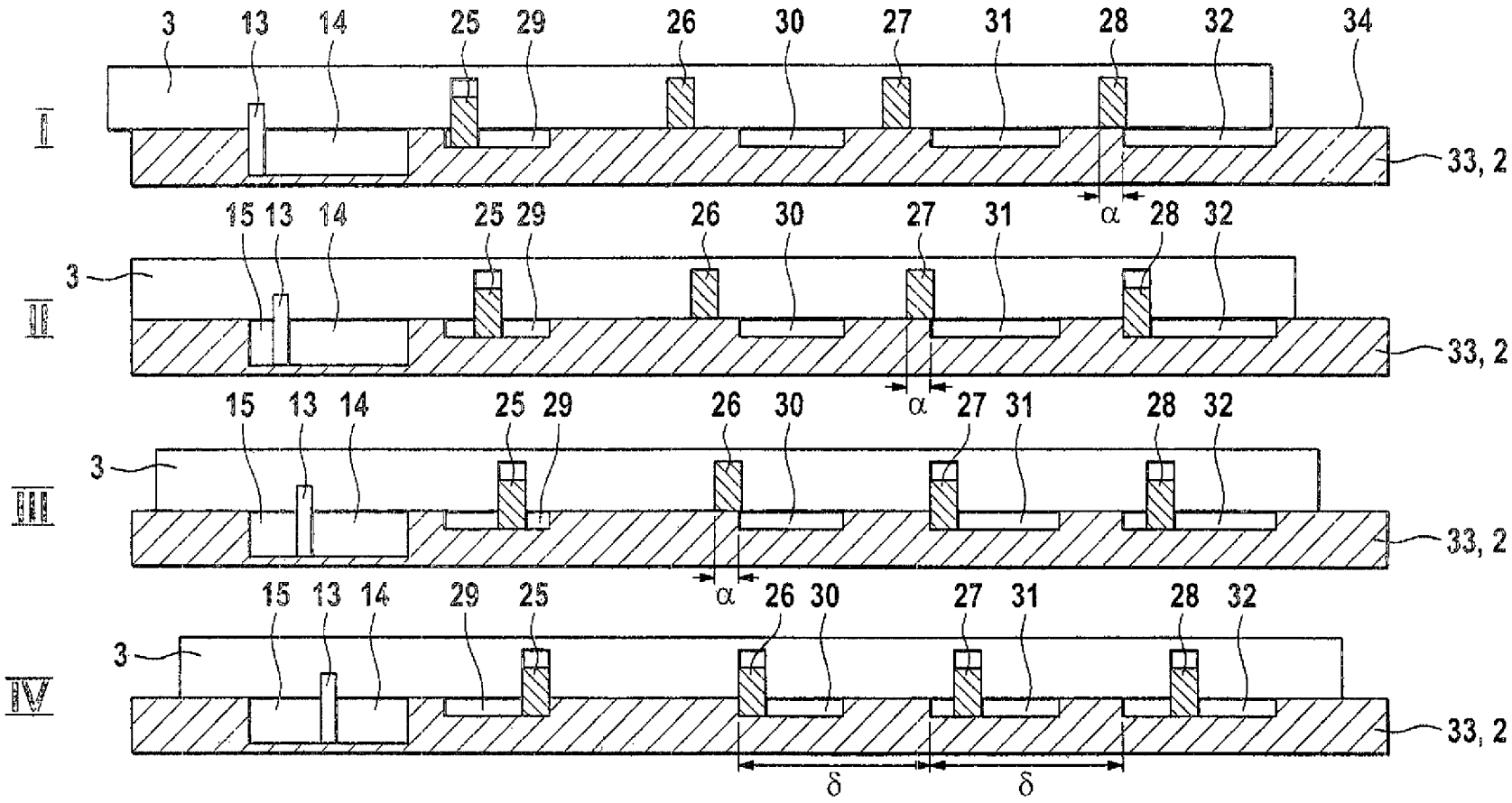
FIG. 7 shows various schematic illustrations to illustrate the positions of the locking bolts in a vane-cell adjuster with a rotor locked in the middle position.

FIG. 7 makes clear a further exemplary embodiment of the invention in the case of a vane-cell adjuster with a rotor locked in a middle position.

The vane-cell adjuster of FIG. 7 differs from the vane-cell adjuster described in connection with FIGS. 1 to 6 merely in the arrangement of the locking bolts and also in the configuration and arrangement of the locking slots of the locking device which causes the rotor to be locked in the middle position. To avoid unnecessary repetition, only the differences from the embodiment of FIGS. 1 to 6 are described, and reference is otherwise made to the statements relating to this.

The locking device of FIG. 7 comprises four locking bolts 25-28 which are arranged so as to be distributed uniformly in the circumferential direction and which, depending on the phase position of the rotor 3, can engage into an associated locking slot 29-32. These are a fifth locking bolt 25 with an associated fifth locking slot 29, a sixth locking bolt 26 with an associated sixth locking slot 30, a seventh locking bolt 27 with an associated seventh locking slot 31 and an eighth locking bolt 28 with an associated eighth locking slot 32.

FIG. 7 makes clear the respective positions of the four locking bolts 25-28 in various phase positions of the rotor 3 by means of schematic illustrations I to IV which, like FIG. 6, show the rotor and stator in "unrolled" axial section. Moreover, the positions of the vanes 13 in the working spaces 12 are made clear, the working space 12 being depicted as located in the stator merely for the purpose of simpler illustration.

Illustration I in this case corresponds to a situation in which the rotor 3 is in the late position. Correspondingly, the vanes 13 bear against the first radial side walls 7. In this phase position, only the fifth locking bolt 25 can engage into the associated fifth locking slot 29. The fifth locking slot 29 extends in the circumferential direction such that it allows early adjustment of the rotor 3 toward the early position.

When there is an insufficient supply of pressure medium, alternating moments are transmitted from the camshaft to the rotor 3 and have the result that the rotor 3 is rotated by the amount of a mean rotary angle β in the direction of early adjustment. If the rotor 3 is in this case rotated by the amount of the smaller rotary angle α, the eighth locking bolt can engage into the eighth locking slot 32, with the result that late adjustment of the rotor 3 is inhibited due to the abutment of the eighth locking slot 28 against the slot wall, but further early adjustment of the rotor 3 toward the middle position is made possible by a corresponding extent of the eighth locking slot 32 in the circumferential direction. This situation in which the rotor 3 is in a "first intermediate position" is shown in illustration II.

As shown in illustration III, further transmission of alternating moments to the rotor 3 has the result that the rotor, then starting from the first intermediate position, is rotated further by the amount of the mean rotary angle β in the direction of early adjustment, so that the seventh locking bolt 27 can engage into the seventh locking slot 31, with the result that late adjustment of the rotor 3 is inhibited due to the abutment of seventh locking bolt 27 against the slot wall, but further early adjustment of the rotor 3 toward the middle position is made possible. The intermediate position, shown in illustration III, of the rotor is designated as the "second intermediate position".

As shown in illustration IV, further transmission of alternating moments to the rotor 3 has the result that the rotor 3, then starting from the second intermediate position, is rotated further into the middle position, so that the sixth locking bolt 26 can engage into the sixth locking slot 30, with the result that late adjustment of the rotor 3 is inhibited due to the abutment of the sixth locking bolt 26 against the slot wall. Since, in the middle position, the fifth locking bolt 29 at the same time inhibits a further change in the phase position of the rotor 3 in the direction of the middle position, the rotor 3 is fixed positively in its middle position by the fifth and eighth locking bolts, with the result that a rotationally fixed lock between the stator and rotor in the middle position is achieved.

As is evident from FIG. 7, the sixth, seventh and eighth locking slots extend in each case in the circumferential direction such that they allow early adjustment of the rotor 3 toward the middle position. Corresponding to the travel of a locking bolt to be executed within an associated locking slot in the event of further early adjustment of the rotor 3, the dimension in the circumferential direction of the eighth locking slot 32 is greater than the dimension in the circumferential direction of the seventh locking slot 31. Likewise, that of the seventh locking slot 31 is greater than that of the sixth locking slot 30. The fifth locking slot 29 is dimensioned in the circumferential direction such that early adjustment of the rotor 3 toward the middle position is made possible and, in the middle position, further early adjustment of the rotor 3 is inhibited due to the abutment of the fifth locking bolt 25 against the slot wall. As indicated for illustration IV, the sixth, seventh and eighth locking slots 30-32 arranged so as to be distributed uniformly in the circumferential direction are in each case spaced apart from one another at an identical rotary angle δ.

LIST OF REFERENCE NUMBERS

1 Vane-cell adjuster
2 Stator
3 Rotor
4 Chain wheel
5 Inner surface area
6 Radial recess
7 First radial side wall
8 Second radial side wall
9 Inner circumferential wall
10 Outer circumference wall
11 Outer surface area
12 Working space
13 Vane
14 First pressure chamber
15 Second pressure chamber
16 First locking bolt
17 Second locking bolt
18 Third locking bolt
19 Fourth locking bolt
20 First locking slot
21 Second locking slot
22 Third locking slot
23 Fourth locking slot
24 Pressure medium line
25 Fifth locking bolt
26 Sixth locking bolt
27 Seventh locking bolt
28 Eighth locking bolt
29 Fifth locking slot
30 Sixth locking slot
31 Seventh locking slot
32 Eighth locking slot
33 Sealing plate
34 Sealing surface
35 Pressure medium corridor

The invention claimed is:

1. A camshaft adjuster for an internal combustion engine, comprising:

a drive part drive-connected to a crankshaft;

an output part which is concentric to the drive part and is connected fixedly in terms of rotation to a camshaft and which is arranged rotationally adjustably with respect to the drive part and of which a relative rotary position with respect to the drive part can be adjusted between two rotary end positions by means of an actuating mechanism, and a locking device, by means of which the drive part and the output part can be locked fixedly in terms of rotation in a rotary locking position, wherein the locking device has four engagement pairs which in each case comprise an axial locking bolt received in the drive part or the output part and a locking slot formed in the corresponding other part, the engagement pairs being designed such that, in an event of a relative rotary position between a rotary end position trailing in a drive direction and the rotary locking position, the locking bolts can be brought into successive engagement with the locking slots during an adjustment of the output part in the drive direction, each successive engagement of the locking bolts and the locking slots inhibiting adjustment of the output part opposite to the drive direction and allowing adjustment in the drive direction until the rotary locking position is reached, and wherein each of the locking slots has a dimension in a circumferential direction that is greater than a dimension in the circumferential direction of other of the locking slots that are successively engaged thereafter, and a first of the four engagement pairs through a last of the four engagement pairs are arranged on the camshaft adjuster in circumferential succession in order of successive engagement.

2. The camshaft adjuster as claimed in claim 1, wherein the engagement pairs are designed such that, in the event of the adjustment of the output part in the drive direction by rotary angles which are identical to one another or different from one another and which are in each case smaller than a mean rotary angle, by which the output part is adjusted on account of alternating moments of the camshaft, the axial locking bolts can engage successively into the respectively assigned locking slots.

3. The camshaft adjuster as claimed in claim 1, wherein the engagement pairs are arranged so as to be distributed uniformly in the circumferential direction.

4. The camshaft adjuster as claimed in claim 1, wherein the rotary locking position is the rotary end position, leading in the drive direction, of the drive part.

5. The camshaft adjuster as claimed in claim 1, wherein the rotary locking position is a middle position located at least approximately in a middle between the two rotary end positions.

6. The camshaft adjuster as claimed in claim 1, wherein the last engagement pair is designed such that the locking bolt can be brought into positive engagement with the assigned locking slot for a rotationally fixed lock of the drive part and output part in the rotary locking position.

7. The camshaft adjuster as claimed in claim 1, wherein rotationally fixed locking of the drive part and the output part takes place by means of two engagement pairs, in one of the two engagement pairs the locking bolt being capable of being brought into engagement with the assigned locking slot in the rotary locking position such that adjustment of the output part opposite to the drive direction is inhibited, and, in the other engagement pair of the two engagement pairs, the locking bolt being capable of being brought into engagement with the assigned locking slot in the rotary locking position such that adjustment of the output part in the drive direction is inhibited.

8. The camshaft adjuster as claimed in claim 1, wherein the camshaft adjuster is designed in the form of a vane-cell adjuster.

9. The camshaft adjuster as claimed in claim 8, wherein the locking bolts are received in a rotor, and the locking slots are formed in a stator.

10. The camshaft adjuster as claimed in claim 9, wherein the stator is an axial cover plate.

11. An internal combustion engine with a camshaft adjuster as claimed in claim 1.

12. A motor vehicle with an internal combustion engine as claimed in claim 11.

* * * * *